United States Patent [19]

Ventura

[11] Patent Number: 4,530,261

[45] Date of Patent: Jul. 23, 1985

[54] WRENCH ASSEMBLY FOR USE WITH MINE WALL SUPPORT BOLTS

[76] Inventor: Robert M. Ventura, P.O. Box 185, Beallsville, Pa. 15313

[21] Appl. No.: 565,590

[22] Filed: Dec. 27, 1983

[51] Int. Cl.[3] ..... B25B 13/00

[52] U.S. Cl. ..... 81/177 UJ; 81/177.85

[58] Field of Search ..... 81/177 UJ, 177.8, 177.9, 81/177 G, 177 PP, 121 R; 403/23, 20, 51, 57, 58, 223

[56] References Cited

U.S. PATENT DOCUMENTS

| | | | |
|---|---|---|---|
| 743,346 | 11/1903 | Swain | 403/223 |
| 1,487,295 | 3/1924 | Throwbridge | 81/177 UJ |
| 2,325,211 | 7/1943 | Abbe | 81/177 UJ |
| 2,722,812 | 11/1955 | Golasky | 81/177 UJ |
| 2,775,912 | 1/1957 | Skage | 81/177 UJ |
| 2,964,980 | 12/1960 | Riley et al. | 81/177 UJ |

*Primary Examiner*—James L. Jones, Jr.

*Attorney, Agent, or Firm*—Paul Bogdon

[57] ABSTRACT

A wrench for use with mine wall support bolts is disclosed. The wrench includes an elongated shaft shaped to be engaged and driven by a mine bolting machine. The shaft is coupled to a bolt socket by a universal joint. A removable, resilient, impermeable sleeve surrounds the universal joint. The sleeve is formed of a non-metallic material having physical properties which limit the movement of the universal joint and also seal the joint against infusion of solid and fluid matter. The sleeve is secured in place by a removable clamp.

2 Claims, 4 Drawing Figures

10
12
14
16
18
19
20
22
30
32
32a
32b
32c
34
34a
34b
34c
36
38
40
42
III
IV

WRENCH ASSEMBLY FOR USE WITH MINE WALL SUPPORT BOLTS

BACKGROUND OF THE INVENTION

This invention relates to a wrench assembly for use with mine support bolts such as are used in supporting the side walls of underground mine passages.

In underground operations, such as mining or excavating, it is common practice to reinforce side walls by bolts that are inserted into a drill hole of the rock formation and are secured thereto by either engagement of an expansion shell on the end of the bolt or adhesively bonding the bolt by a thermosetting resin placed in the drill hole so that upon curing the bolt is united with the rock formation. The drill hole is usually formed at an incline from the vertical plane of the side wall of the formation. The support bolts, which may be upwards of eight feet in length, are rotated in the drill holes by a mine bolting machine. A wrench which engages the head of a bolt is driven by the bolting machine. The typical wrench has an elongated shaft joined to a socket.

In a typical mine side wall support arrangement the support bolt has a tendency to shift its position within the drill hole. When a bolt shifts its longitudinal axis will no longer be in line with the axis of the drill hole. The wrench is always aligned with the drill hole and when a bolt shifts this wrench will not shift with it. As a result the socket of the wrench will often come off of the bolt head and the bolting machine will then cease tightening the bolt within the drill hole. The bolt will, in virtually all cases, remain loosely installed and will not provide the required support to the side wall. The loose bolt problem is without satisfactory remedy as the only way to tighten the shifted bolt is by hand, and that method will not provide the compression force needed to result in the desired support.

This invention overcomes the problem of shifting side wall support bolts by providing a wrench which will bend as the bolt shifts and thereby permit the bolting machine to continue to drive the bolt until the necessary compression force is placed on the side wall of the rock formation.

SUMMARY OF THE INVENTION

The present invention provides a novel wrench assembly for use with mine support bolts. The wrench, in its preferred form, includes an elongated shaft having one end shaped to be received and secured by a drive mechanism of a mine support bolting machine. The shaft is secured to a socket for receiving the head of a support bolt by a universal joint. A resilient, impermeable sleeve means surrounds the entire structure forming the universal joint. The sleeve is constructed and arranged such that it will limit the movement of the universal joint whenever a significant lateral force is applied to the socket as will result when a bolt shifts in a drill hole of a side wall in an underground mine. A universal joint without the sleeve of this invention would shift whenever any lateral force is applied to the socket of shaft which would result in the wrench being rendered ineffective for applying the needed longitudinally directed force to the support bolt. In addition to limiting the movement of the universal joint, the sleeve seals the joint from infusion of any solid or fluid matter. Thus, the sleeve protects the joint from collecting particulate matter which could damage the joint or require regular time consuming cleaning.

In its preferred form the wrench of this invention has a hollow main shaft which communicates with a central passageway through the socket by way of the universal joint. The surrounding sleeve provides a continuous passageway from the bolting machine to the interior of the socket. The continuous passageway serves an important function as will be explained. The mine bolting machine has means for circulating cooling air around a pump which forms an important part of the machine. The air circulator also draws a partial vacuum on the drive chuck which receives and secures the wrench. The vacuum, in turn, will be drawn on the support bolt head through the continuous passageway. That partial vacuum will aid the socket in holding the bolt in place. Also, it will be significantly easier to remove the wrench from the chuck of the bolting machine as compared with a wrench having a solid shaft upon which the partial vacuum will act.

In addition to the above mentioned advantages, the combined structure of the wrench of this present invention is also safe to use because the sleeve will prevent any entanglement with the universal joint. The sleeve will also protect the universal joint against damage from any heavy objects which could strike an otherwise unprotected universal joint.

Various other advantages, details, and modifications of the present invention will become apparent as the following description of a present preferred embodiment proceeds.

DESCRIPTION OF THE DRAWINGS

In the accompanying drawings I show a present preferred embodiment of this invention in which.

DESCRIPTION OF THE PREFERRED EMBODIMENT

Figures 1, 2, 3, 4:
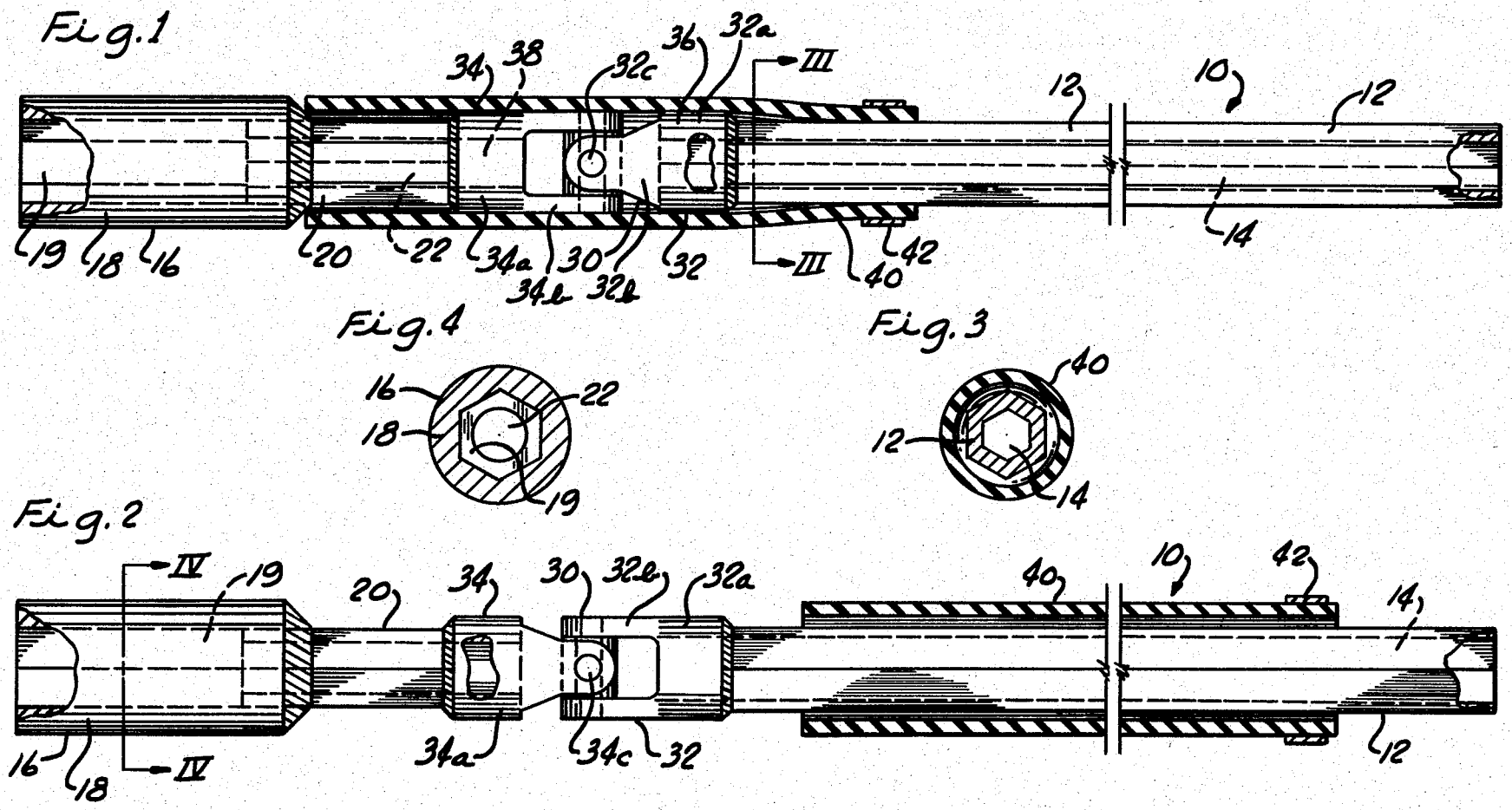
FIG. 1 is a side elevation view of a wrench assembly of the present invention for use with mine support bolts with certain elements partly or entirely in section to show details of construction.
FIG. 2 is a side elevation view of the wrench assembly of FIG. 1 rotated ninety degrees and showing the sleeve removed from the area of the universal joint.
FIG. 3 is a view looking along the line III—III of FIG. 1.
FIG. 4 is a view looking along the line IV—IV of FIG. 1.

Referring now to the drawings, 10 represents the wrench assembly of this invention for use with bolts of the type used to support the side walls of rock formations of underground mines or excavations. The wrench 10 includes an elongated shaft 12 having a length of approximately two feet and being of a hexagonal cross-sectional shape suitably sized to be received and secured at its one end section by a chuck forming part of the bolt drive mechanism of a mine bolting machine. The shaft 12 is also provided with an uninterrupted longitudinal passageway 14 throughout its length. Wrench 10 also includes a generally cylindrically shaped socket 16 having a main housing 18 with an internal core 19 of a cross-sectional shape of the same configuration as that of a bolt head being engaged. The main housing 18 is securely and permanently connected with a stub-shaft 20 which is provided with an uninterrupted longitudinal passageway 22 in communication with the internal core 19.

Shaft 12 and socket 16 are longitudinally, coaxially connected with each other by a universal joint 30 having a well-known double pivot construction. Both pivot sections 32 and 34 are essentially the same in construction, each having base members 32*a* and 34*a* connected with yokes 32*b* and 34*b* pivotably connected to each other by pivot pins 32*c* and 34*c*. Base member 32*a* is fixed to the inner end of the shaft 12, and is provided with a longitudinal passageway 36 which communicates with passageway 14 of the shaft 12. Passageway 36 also communicates with the space between the arms forming the yoke 32*b*. Base member 34*a* is fixed to stub-shaft 20 of the socket 16, and is provided with a longitudinal passageway 38 which communicates with passageway 22 of the stub-shaft 20. Passageway 38 also communicates with the space between the arms forming the yoke 34*b*. A continuous, uninterrupted passageway is defined by the interconnected passageway 14 of shaft 12, passageways 36 and 38 of the universal joint 30, the spacing defined by the yokes 32*b* and 34*b*, and passageway 22 of socket 16.

As elongated, cylindrically tubular, resilient, impermeable sleeve 40 formed of a suitable non-metallic material such as neoprene rubber surrounds the entirety of the universal joint 30. The sleeve 40 is approximately six inches long with an inner diameter sized to be snugly, yet removably, received on the shaft 12. The wall thickness of the sleeve 40 is approximately $\frac{1}{4}$ inch. As shown in FIG. 1, the sleeve 40 is arranged to extend from the inner end of the housing 18 of socket 16 to part way of the inner end section of shaft 12. A band-type ring clamp 42 is used at the shaft 12 end of the sleeve 40 to secure the sleeve in place. The size of the sleeve 40 and the material of its construction are suitably selected to limit or resist the movements of the universal joint 30 when a lateral force of predetermined value applied to either the shaft 12 or socket 16 is exceeded. A typical lateral force to be considered would be of the nature applied to the socket 16 by a bolt which shifts in a drill hole when being installed. The precise magnitude of the predetermined lateral force does not need to be known. The intent of this invention is to keep the universal joint 30 restrained against movement by minor lateral forces such as might result by a very slight misalignment of the wrench 10 and the bolt to be installed. It is necessary that the wrench 10 transmit a longitudinal force to the bolt during installation and that function would be thwarted should the universal joint 30 be permitted to have free movement. Thus, the predetermined lateral force as used in this specification and in the claims is simply ascertained without the need for establishing a precise value by simply handling the sleeve 40 by itself and moving the universal joint 30 with the sleeve 40 in place surrounding the universal joint. Those skilled in this art would be able to readily ascertain the construction of sleeve 40 since they would know the degree of restraint needed on the movement of the universal joint 30 to allow for proper installation of a bolt in a drill hole of a side wall of a mine passage when a bolt shifts its orientation in the drill hole.

The type of material used for sleeve 40 should also be impermeable to solid and fluid matter. With sleeve 40 being snugly emplaced around the universal joint 30 the joint will be sealed against infusion of any solid and fluid matter. In addition, the sleeve 40 protects the integrity of the continuous passageway throughout the length of the wrench. Thus, when a partial vacuum is established in the bolting machine it will be extended through the continuous passageway to act on the head of a bolt being installed, thereby aiding the socket 16 in holding the bolt in place during installation.

The advantages of the wrench 10 of the present invention have been carefully detailed in the introductory portion of this specification. It should now be clearly understood how those advantages are achieved.

While I have shown and described a present preferred embodiment of this invention it is to be distinctly understood that the invention is not limited thereto, but may be otherwise variously embodied within the scope of the following claims.

I claim:

1. A mine wall support bolt wrench assembly, comprising:

an elongated shaft having a continuous longitudinal passageway therethrough and having one end shaped to be received and secured by a drive mechanism of a mine support bolting machine;

socket means for snuggly receiving the head of a mine support bolt, said socket means having a continuous longitudinal passageway extending therethrough;

universal joint means for joining said shaft at its outer end to said socket means;

said shaft passageway and said socket passageway communicating with each other across said universal joint; and resilient, impermeable, non-metallic sleeve means surrounding the entirety of said universal joint means for limiting the magnitude of movement of said universal means when a lateral force above a predetermined value applied to either of said shaft or socket means is exceeded and for maintaining the continuity between said passageways and for sealing said universal joint means against infusion of solid and fluid matter.

2. The mine wall support bolt wrench assembly as set forth in claim 1 including locking means for locking said sleeve means in place.

* * * * *